US007175407B2

(12) United States Patent
Clark

(10) Patent No.: US 7,175,407 B2
(45) Date of Patent: Feb. 13, 2007

(54) LINEAR FLOW EQUALIZER FOR UNIFORM POLYMER DISTRIBUTION IN A SPIN PACK OF A MELTSPINNING APPARATUS

(75) Inventor: Steven D. Clark, Cumming, GA (US)

(73) Assignee: Aktiengesellschaft Adolph Saurer (DE)

( * ) Notice: Subject to any disclaimer, the term of this patent is extended or adjusted under 35 U.S.C. 154(b) by 360 days.

(21) Appl. No.: 10/625,352

(22) Filed: Jul. 23, 2003

(65) Prior Publication Data

US 2005/0017400 A1 Jan. 27, 2005

(51) Int. Cl.
*D01D 5/30* (2006.01)

(52) U.S. Cl. ..... 425/131.5; 425/198; 425/192 S; 425/463; 425/382.2

(58) Field of Classification Search ..... 425/131.5, 425/198, 192 S, 463, 382.2; 264/172.14, 264/172.15, 172.17
See application file for complete search history.

(56) References Cited

U.S. PATENT DOCUMENTS

| | | | | |
|---|---|---|---|---|
| 3,034,526 | A | 5/1962 | Roselle | 137/1 |
| 3,687,589 | A * | 8/1972 | Schrenk | 425/131.1 |
| 4,035,127 | A | 7/1977 | Ogasawara et al. | 425/192 S |
| 4,406,850 | A | 9/1983 | Hills | 264/171 |
| 4,732,716 | A * | 3/1988 | Sakunaga et al. | 264/1.28 |
| 4,738,607 | A | 4/1988 | Nakajima et al. | 264/131.5 |
| 5,162,074 | A | 11/1992 | Hills | 156/644 |
| 5,344,297 | A | 9/1994 | Hills | 425/131.5 |
| 5,354,529 | A | 10/1994 | Berger et al. | 264/176.1 |
| 5,466,410 | A | 11/1995 | Hills | 264/172.11 |
| RE35,108 | E * | 12/1995 | Hagen et al. | 264/176.1 |
| 5,551,588 | A | 9/1996 | Hills | 216/56 |
| 5,562,930 | A | 10/1996 | Hills | 425/198 |
| 5,620,644 | A | 4/1997 | Hodan et al. | 264/169 |
| 5,736,083 | A * | 4/1998 | Dugan | 264/103 |
| 5,851,562 | A * | 12/1998 | Haggard et al. | 425/131.5 |
| 6,261,080 | B1 | 7/2001 | Schroter et al. | 425/378.2 |
| 6,478,563 | B1 | 11/2002 | Allen | 425/131.5 |
| 6,491,507 | B1 | 12/2002 | Allen | 425/7 |
| 2002/0094352 | A1 | 7/2002 | Guo | 425/131.5 |
| 2004/0126454 | A1 * | 7/2004 | Haynes et al. | 425/382.2 |

* cited by examiner

*Primary Examiner*—Joseph S. Del Sole
(74) *Attorney, Agent, or Firm*—Moore & Van Allen PLLC

(57) ABSTRACT

A linear flow equalizer for distributing thermoplastic material to a spin pack of a meltspinning apparatus that provides for uniform apportionment of a flow of a flowable thermoplastic material at least vertically and in a cross-machine direction of the spin pack. The linear flow equalizer includes an inlet plate with multiple liquid passageways equidistantly spaced in the cross-machine direction that each provide flowable thermoplastic material to a set of equalizer plates. Elongated slots extending through alternating equalizer plates are registered with throughholes extending through adjacent plates in the equalizer plate set. Each throughhole in an upstream equalizer plate is registered with the center of a corresponding slot and each throughole in a downstream equalizer plate is registered with one of opposed closed ends of a corresponding slot.

21 Claims, 4 Drawing Sheets

LINEAR FLOW EQUALIZER FOR UNIFORM POLYMER DISTRIBUTION IN A SPIN PACK OF A MELTSPINNING APPARATUS

FIELD OF THE INVENTION

The present invention relates generally to melt-spinning apparatus and methods, and more particularly to a linear flow equalizer for a spin pack of a melt-spinning apparatus and methods of forming non-woven webs with a melt-spinning apparatus incorporating the linear flow equalizer of the invention.

BACKGROUND OF THE INVENTION

Non-woven webs are incorporated into a diversity of consumer and industrial products, including disposable hygienic articles, throwaway protective apparel, fluid filtration media, and household durables. Generally, non-woven webs are formed using melt-spinning technologies, such as spunbonding processes and meltblowing processes, that form continuous filaments or fibers composed of one or more thermoplastic polymers. Spunbond non-woven webs are relatively strong in both the machine and the cross-machine directions because of drawing that aligns the polymer molecules. The continuity of the filaments also contributes to the observed strength of spunbond non-woven webs. Spunbond non-woven webs also resist abrasion, have a high porosity, and may be soft and conformable.

Spunbonding processes generally involve pumping one or more molten thermoplastic polymers through a spin pack that distributes, filters, combines, and finally extrudes continuous filaments of the constituent thermoplastic polymer (s) through hundreds or thousands of spinneret holes or orifices in a spinneret. After extrusion, the filaments are cooled or quenched to increase their viscosity and then drawn or stretched by an impinging high-velocity airflow generally capable of orienting the molecules of each constituent thermoplastic polymer if the air velocity is sufficiently high. The airflow propels the drawn filaments toward a forming zone to form a non-woven web on a moving collector.

The spin pack distributes a flow of each constituent thermoplastic polymer from a few inlet ports to individual outlet ports that span the width of the spin pack. Specifically, the molten thermoplastic polymer from each inlet port is directed into a shared lateral flow passageway and individual portions of the incoming thermoplastic polymer are allocated from the lateral flow passageway to the outlet ports for subsequent distribution to the orifices in the spinneret plate. Because all of the inlet ports share a single lateral flow passageway, thermoplastic material streaming from adjacent inlet ports into the lateral flow passageway intersects, collides and mixes before arriving at the outlet ports. The intersecting streams of molten thermoplastic polymer may experience hold-ups, dead spots or stagnation zones, and/or recirculation within the lateral flow passageway. The individual streams of the polymer(s) from the outlet ports are ultimately supplied to the orifices in the spinneret.

The inability to uniformly divide the incoming stream of the molten thermoplastic polymer in the machine direction and in the cross-machine direction with uniform flow characteristics to the outlet ports causes unacceptable variations in the non-woven web formed by the spunbonding process. For example, non-uniform distribution of the molten thermoplastic polymer in cross-machine direction may cause the basis weight of the non-woven web to fluctuate in the cross-machine direction, which produces perceptible strips of varying basis weight extending parallel to the machine direction. In particular, the basis weight of the non-woven web originating from filaments extruded from spinneret orifices receiving thermoplastic polymer from outlet ports directly downstream of an inlet port has been observed to be significantly larger than the basis weight of the non-woven web originating from filaments extruded from spinneret orifices receiving thermoplastic polymer from outlet ports near the mid-point between adjacent inlet ports. The fluctuation in the basis weight is believed to arise from unequal flow path lengths in the shared lateral flow passageway. This results in non-uniform residence times and pressure drops for different portions of the non-Newtonian thermoplastic polymer exiting the outlet ports from the lateral flow passageway. The non-uniform flow path lengths also result in disparate shear histories for different portions of the thermoplastic polymer flowing in the lateral flow passageway reflected in the polymer properties and the characteristics of the non-woven web formed therefrom.

It would be desirable, therefore, to provide a spin pack for a melt-spinning apparatus capable of forming a non-woven web having improved basis weight uniformity in the cross-machine direction.

SUMMARY

In one aspect, the invention is directed to an apparatus for distributing thermoplastic material supplied to a spin pack of a meltspinning apparatus. The apparatus includes a linear flow equalizer having a plurality of flow passageways of substantially equal length that divide a flow of a thermoplastic material supplied from a plurality of liquid inlet ports into individual streams having a spaced relationship in a cross-machine direction.

In one specific embodiment of the apparatus of the invention, the linear flow equalizer includes an inlet plate having a plurality of liquid passageways spaced substantially equidistantly in a cross-machine direction of the meltspinning apparatus, a first equalizer plate positioned downstream from the inlet plate, and a second equalizer plate positioned downstream from the first equalizer plate. The first equalizer plate has elongated slots each centered about one of the plurality of liquid passageways. Each of the first plurality of elongate slots extends in the cross-machine direction and includes opposed closed ends substantially equidistant from one of the plurality of liquid passageways. The second equalizer plate has throughholes each substantially registered in alignment with one of the opposed closed ends of a corresponding one of the first plurality of elongated slots.

Another aspect of the invention is directed to a method of distributing thermoplastic material supplied to a spin pack to form a non-woven web. To that end, a flow of thermoplastic material is divided in a cross-machine direction of a spin pack among liquid passageways of substantially equal path length to form individual streams of thermoplastic material spaced in the cross-machine direction. The individual streams of thermoplastic material are shaped or formed into filaments, which are quenched, drawn, and collected to produce the non-woven web.

In accordance with the principles of the invention, the flows of thermoplastic material within the linear flow equalizer are partitioned homogeneously and symmetrically in the cross-machine direction and vertically in a downstream direction. The basis weight of the non-woven web produced by a melt spinning apparatus incorporating the linear flow equalizer of the invention is more uniform in the cross-machine direction. The improved uniformity in the basis weight is believed to arise from equal or nearly equal flow path lengths in the spin pack, which results in more uniform residence times and pressure drops for different divided portions of the thermoplastic polymer and approximately equal shear histories. As a result, the properties of the non-woven web are substantially independent of the lateral location of the outlet port from the final downstream equalizer plate relative to the individual inlets in the inlet plate. In accordance with the principles of the invention, the linear flow equalizer of the invention optimizes the flow distribution of the thermoplastic polymer(s) while achieving a uniform shear rate and a minimum residence time in the die pack.

These and other objects and advantages of the present invention shall become more apparent from the accompanying drawings and description thereof.

BRIEF DESCRIPTION OF THE FIGURES

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION OF THE INVENTION

Figure 1:
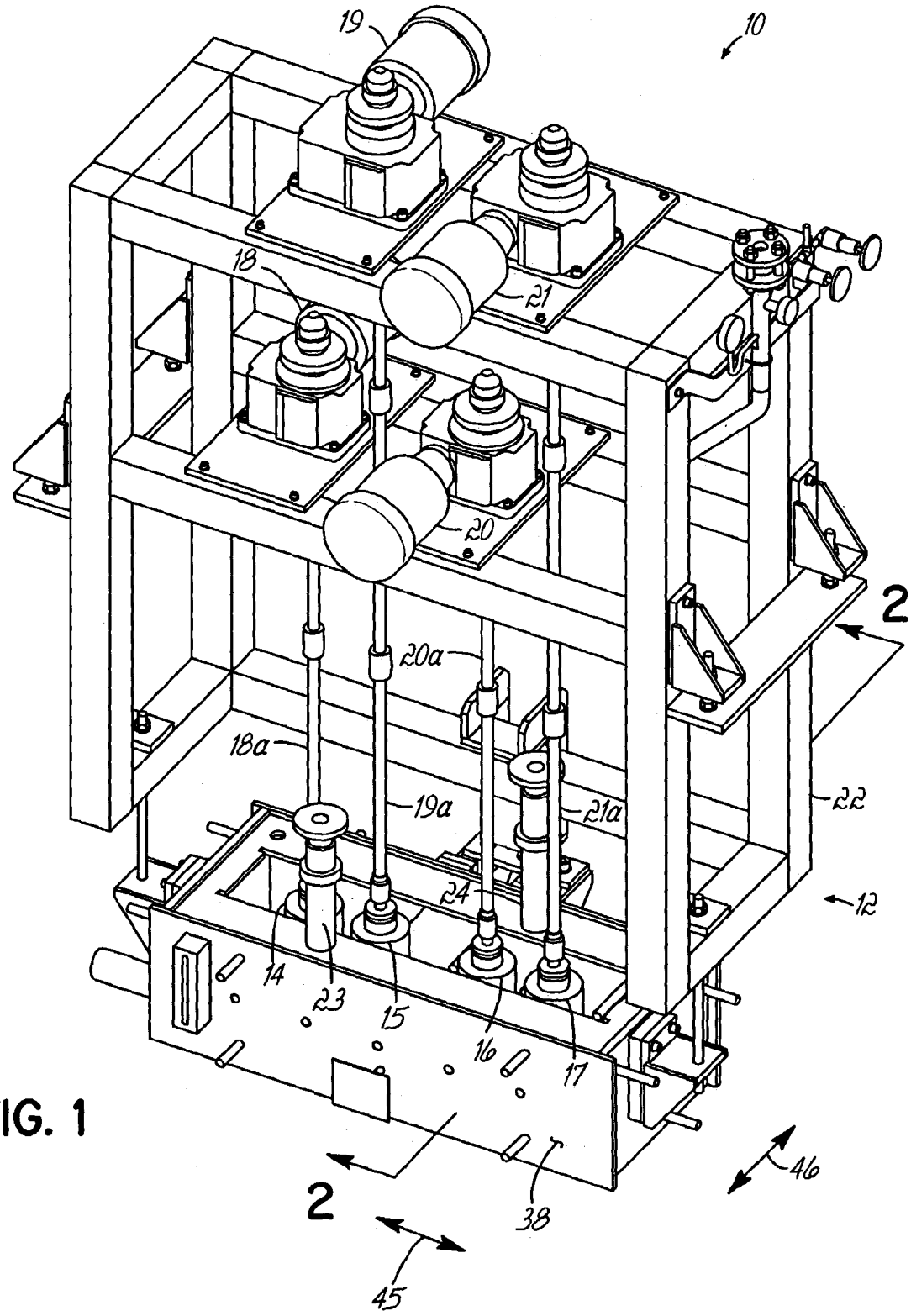
FIG. 1 is a perspective view of a spin beam assembly.
Figure 2:
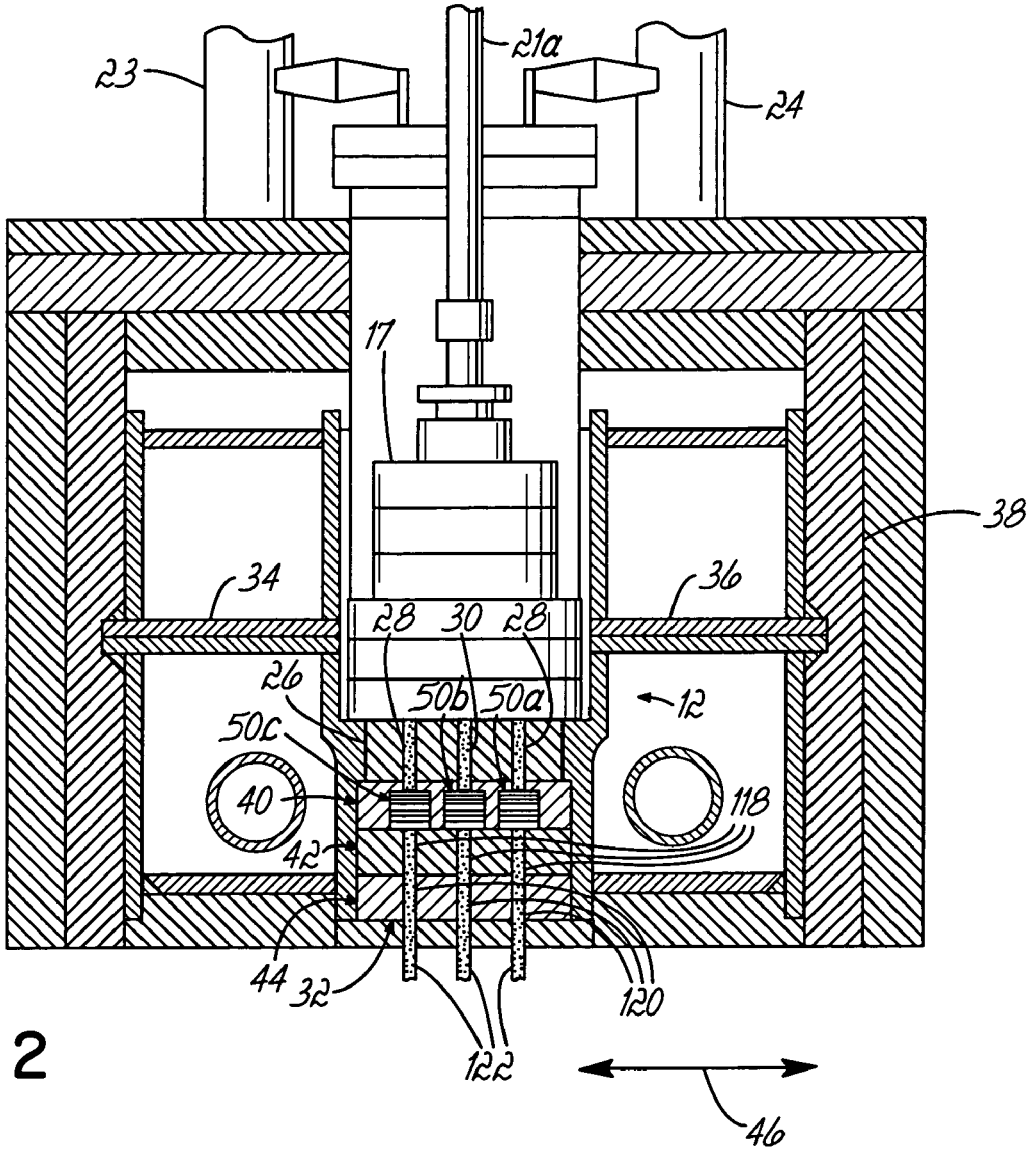
FIG. 2 is a partial cross-sectional view taken generally along lines 2—2 in FIG. 1.

With reference to FIGS. 1 and 2, a spin beam assembly, generally indicated by reference numeral 10, for forming filaments includes a chassis 12 holding drive pumps 14, 15, 16, 17 each driven by a corresponding one of a set of motors 18, 19, 20, 21. The motors 18–21 are suspended from the chassis 12 by an open framework of beams 22 and generally overlie the drive pumps 14–17. Extending from each of the motors 18–21 is a drive shaft 18*a*, 19*a*, 20*a*, 21*a* that supplies a drive coupling with a corresponding one of the drive pumps 14–17. The spin beam assembly 10 is incorporated into a melt-spinning apparatus that includes conventional components, such as a filament-drawing device for attenuating the filaments and a moving collector located on a forming table, for forming a non-woven web.

Drive pumps 14 and 16 receive a flow of a first polymer (Polymer A) furnished by a supply line 23 from an extruder (not shown) and drive pumps 15 and 17 receive a flow of a second polymer (Polymer B) furnished by a separate supply line 24 from another extruder (not shown). The invention contemplates that the drive pumps 14–17 may be supplied by a single supply line communicating with and service by a single extruder. The first and second polymers may differ in composition, such as polyethylene and polypropylene, or may constitute two polymers of identical composition that differ with respect to a property such as melt flow rate or the presence or absence of an additive. The two polymers are heated to a temperature sufficient to produce a liquid or semi-solid material having a viscosity suitable for flow through an arbitrary set of passageways.

With continued reference to FIGS. 1 and 2, a pump plate 26 attached to the chassis 12 supports the pumps 14–17. Extending through the pump plate 26 is a plurality of liquid passageways 28, of which two liquid passageways 28 are shown in FIG. 2, arranged in rows such that each is coupled in fluid communication with an outlet of one of the drive pumps 14, 16. Also extending through the pump plate 26 is a plurality of liquid passageways 30, of which one liquid passageway 30 is shown in FIG. 2, each coupled in fluid communication with an outlet of one of the drive pumps 15, 17. Accordingly, each pump 14, 16 outputs a stream of polymer A to the liquid passageways 28 and each pump 15, 17 outputs a stream of polymer B to the liquid passageways 30.

The spin beam assembly 10 further includes a spin pack, generally indicated by reference numeral 32, supported by support brackets 34, 36 within a housing 38 of chassis 12. The spin pack 32 receives separate flows of the two polymers from the liquid passageways 28, 30 in pump plate 26. The spin pack 32 is an assembly that incorporates, in order from a top or upstream side to a bottom or downstream side, a linear flow equalizer 40, a combining plate 42, and a spinneret plate 44. A major or long axis of the spin pack 32 is aligned generally parallel to a cross-machine direction 45 (FIG. 1), which is generally orthogonal to a machine direction 46. A collector (not shown) collects the filaments discharged from the spinneret plate 44 of spin pack 32.

Figure 3:
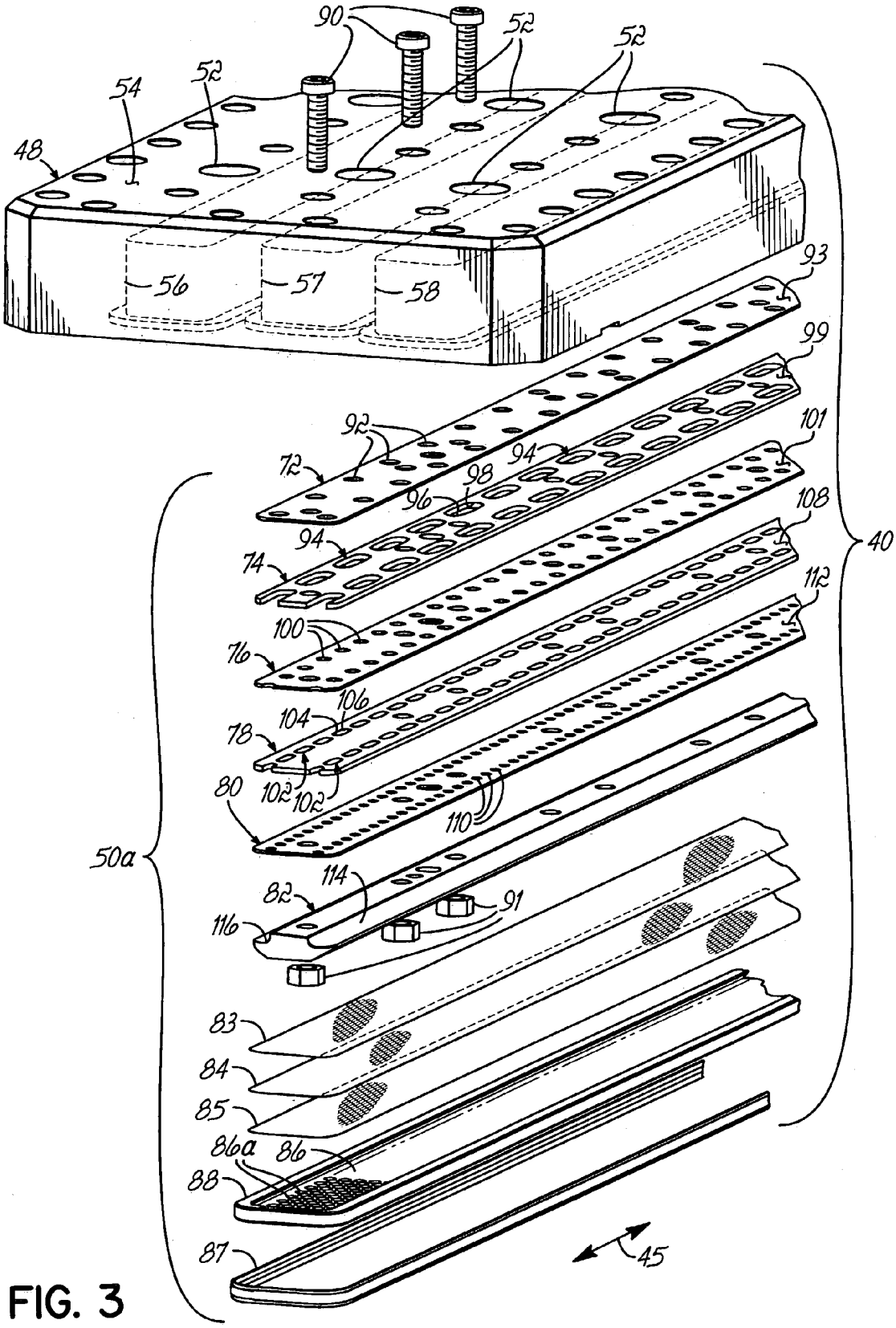
FIG. 3 is an exploded view of a linear flow equalizer for a spin pack in accordance with the principles of the invention.

With reference to FIGS. 2 and 3, the linear flow equalizer 40 is an assembly constituted by an inlet plate 48 and three equalizer plate sets 50*a*–*c*. The inlet plate 48 includes inlet ports or passageways 52, visible in FIG. 3, arranged in three spaced linear rows to coincide with the locations of liquid passageways 28, 30. Adjacent inlet passageways 52 in each of the rows are spaced at equal centerline-to-centerline intervals, or a uniform pitch, across the width of the inlet plate 48. In one specific embodiment of the invention, the inlet plate 48 features three rows of eight inlet passageways 52.

Inlet passageways 52 in the center row are registered for fluid communication at an upstream surface 54 of inlet plate 48 with the liquid passageways 30 in the pump plate 26. Similarly, inlet passageways 52 in the two rows flanking the center row are registered in fluid communication at the upstream surface 54 of inlet plate 48 with the liquid passageways 28 in the pump plate 26. Accordingly, each inlet passageway 52 in the center row receives an output stream of polymer B from one of pumps 15, 17 and each inlet passageway 52 in the rows flanking the center row receives an output stream of polymer A from one of pumps 14, 16. The rows of inlet passageways 52 in inlet plate 48 adjacent the front and rear edges of the spin pack 32 distribute respective output streams of Polymer A to the equalizer plate sets 50*a*, 50*c*. The central row of inlet passageways 52 distributes an output stream of Polymer B to the center equalizer plate set 50*b*.

In accordance with the principles of the invention, the fluid pathways in the linear flow equalizer 40 define approximately equal length lateral and vertical flow paths and, preferably, equal length flow paths, for each polymer stream in a flow path extending from the downstream side of the pump plate 26 to the downstream side of each of the equalizer plate sets 50*a–c*. The approximately equal lengths of the lateral and vertical flow paths in the linear flow equalizer 40 result in approximately uniform residence times and shear histories characterizing the polymer flows through the linear flow equalizer 40. Preferably, the lateral and vertical flow paths for the polymers in the linear flow equalizer 40 are equal in length for providing optimum filament properties. Consequently, material properties of the resultant non-woven, such as basis weight, possess an improved uniformity in the cross-machine direction 45.

Figure 4:
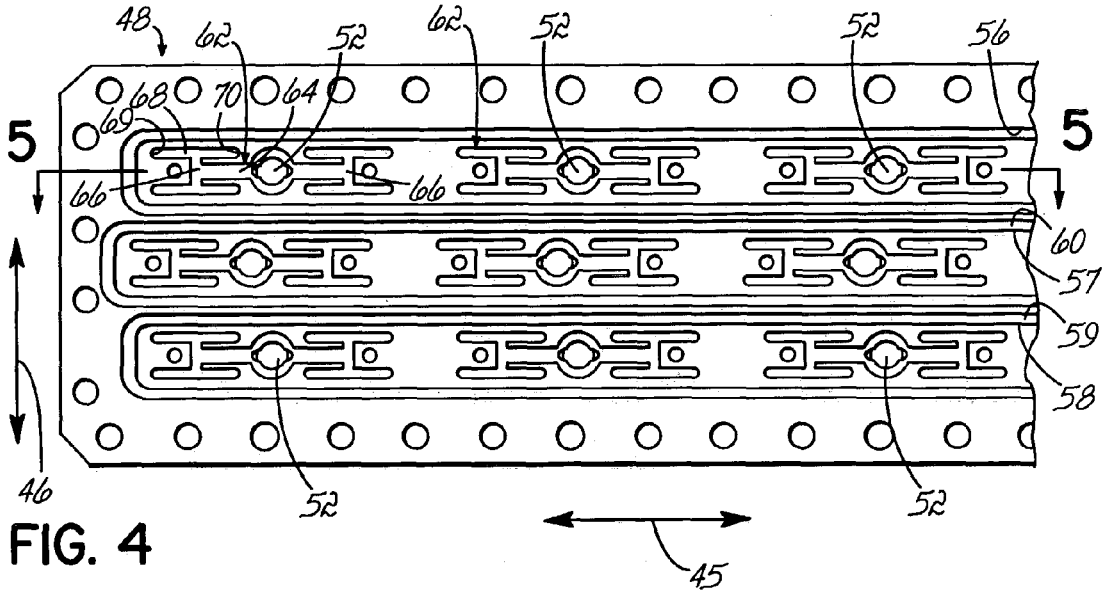
FIG. 4 is a bottom view of the inlet plate of the spin pack of FIG. 3.
Figure 5:
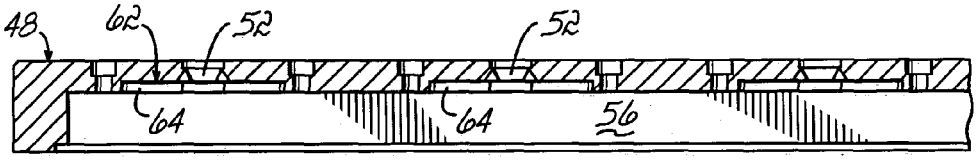
FIG. 5 is a cross-sectional view taken generally along lines 5—5 in FIG. 4.

With reference to FIGS. 3–5, the inlet plate 48 includes shallow rectangular recesses or cavities 56, 57, 58 partitioned from one another by dividing walls 59, 60. Each of the cavities 56, 57, 58 is dimensioned to receive one of the equalizer plate sets 50*a–c*. A downstream surface of each cavity 56, 57, 58 includes a series of shallow multi-segment channels 62 each centered about an outlet of one of the inlet passageways 52. The channels 62 define a second stage or level of lateral and vertical thermoplastic material distribution in the linear flow equalizer 40.

Each channel 62 includes a linear segment 64 extending in the cross-machine direction 45 and centered or symmetrical about inlet passageway 52. Linear segment 64 terminates at each opposed open end in fluid communication with the center of a corresponding one of a pair of linear segments 66 each extending in the machine direction 46. The linear segments 66 are equidistant in the cross-machine direction 45 from the corresponding inlet passageway 52. Each of the linear segments 66 is centered or symmetrical about the intersection with linear segment 64 and terminates at each open end in fluid communication with a slotted linear segment 68. Each slotted linear segment 68 extends in the cross-machine direction 45 and includes a pair of opposed curved terminal or closed ends 69, 70. Each slotted linear segment 68 is centered or symmetrical about the intersection with the corresponding one of the linear segments 66. Therefore, the flow path length for the flowable thermoplastic material in each channel 62 is substantially equal and, preferably equal, from the inlet passageway 52 to the closed ends 69, 70 of each slotted linear segment 68.

As each of the equalizer plate sets 50*a–c* have identical constructions, only one equalizer plate set 50*a* is shown in FIG. 3 and is described herein. Equalizer plate set 50*a* includes a plurality of, for example, five equalizer plates 72, 74, 76, 78 and 80, a sheet-forming plate 82, removable mesh filters 83, 84, and 85, a filter support plate 86, and a seal 87 arranged in juxtaposition from the top or upstream side to the bottom or downstream side. The filter support plate 86 has a peripheral rim 88 surrounding a generally rectangular recess that captures the filters 83, 84, 85 in the set assembly. The equalizer plates 72, 74, 76, 78 and 80 are secured together and fastened to the inlet plate 48 by conventional fasteners 90 extending from countersunk openings in the inlet plate 48 through appropriately aligned bolt holes formed in each of the equalizer plates 72, 74, 76, 78 and 80 and secured by nuts 91 situated in countersunk openings on the downstream side of the sheet-forming plate 82.

Each of the equalizer plates 72, 74, 76, 78 and 80 is formed by milling or drilling a thin rectangular sheet of a suitable material using computer numerically controlled (CNC) machining. For example, equalizer plates 72, 74, 76, 78 and 80 may be formed by CNC machining from sheets of a metal alloy, such as 17-4 stainless steel, having thermal expansion characteristics compatible with the surrounding metal environment of the spin pack 32. The equalizer plats 72, 74, 76, 78 and 80 may also be fabricated by alternative manufacturing techniques, such as by laser or chemical machining or by stamping.

With reference to FIG. 3, equalizer plate 72 is positioned downstream of the inlet plate 48 and includes a plurality of flow passageways in the form of circular bores or thoughholes 92 extending vertically through the thickness of plate 72 from an upstream inlet to a downstream outlet. Contact between the equalizer plate 72 and the inlet plate 48 closes the channels 62 to define flow paths in equalizer plate 72 to the throughholes 92. The throughholes 92 are arranged in two spaced linear rows such that each throughhole 92 is registered on an upstream surface 93 of plate 72 in substantial vertical alignment with one of the closed ends 69, 70 of one of the slotted linear segments 68 in equalizer plate 72. Adjacent throughholes 92 in each of the rows are spaced at equal centerline-to-centerline intervals, or a uniform pitch, across the width of the equalizer plate 72. The throughholes 92 receive flowable thermoplastic material from the channels 62 in inlet plate 48 and define individual liquid inlets supplying flowable thermoplastic material to equalizer plate 74. The channels 62 and the throughholes 92 collectively define a second stage or level of lateral and vertical thermoplastic material distribution in the linear flow equalizer 40.

Equalizer plate 74 is positioned downstream of equalizer plate 72 and includes a plurality of slotted flow passageways 94 extending vertically through the thickness of plate 74 from an upstream inlet to a downstream outlet. A major axis of each slotted flow passageway 94 is aligned generally in the cross-machine direction 45. The center of each slotted flow passageway 94 is registered on an upstream surface 99 of equalizer plate 74 in substantial vertical alignment with one of the throughholes 92 in equalizer plate 72. Throughholes 92 and channels 62 cooperate to also divide the flow of thermoplastic material into two separate laterally-extending rows. As a result, opposed curved terminal or closed ends 96, 98 of each slotted flow passageway 94 are substantially centered or symmetrical in the cross-machine direction 45 relative to the corresponding throughhole 92.

With continued reference to FIG. 3, equalizer plate 76 is positioned downstream of equalizer plate 74 and includes a plurality of flow passageways in the form of circular bores or thoughholes 100 extending vertically through the thickness of plate 76 from an upstream inlet to a downstream outlet. Each throughhole 100 is registered on an upstream surface 101 of equalizer plate 76 in substantial vertical alignment with one of the closed ends 96, 98 of one of the slotted flow passageways 94 in equalizer plate 74. Adjacent throughholes 100 in each of the rows are spaced at equal centerline-to-centerline intervals, or a uniform pitch, across the width of the equalizer plate 76. The throughholes 100 in equalizer plate 76 and the slotted flow passageways 94 in equalizer plate 74 define a third stage or level of lateral and vertical thermoplastic material distribution in the linear flow equalizer 40.

Equalizer plate 78 is positioned downstream of the equalizer plate 76 and includes a plurality of slotted flow passageways 102 extending vertically through the thickness of equalizer plate 78 from an upstream inlet to a downstream outlet. A major axis of each slotted flow passageway 102 is aligned substantially in the cross-machine direction 45. The center of each slotted flow passageway 102 is registered on an upstream surface 108 of equalizer plate 78 in substantial vertical alignment with one of the throughholes 100 in equalizer plate 76, which define individual liquid inlets supplying flowable thermoplastic material to equalizer plate 78. As a result, opposed curved terminal or closed ends 104, 106 of each slotted flow passageway 102 are substantially centered or symmetrical in the cross-machine direction 45 relative to the corresponding throughhole 100.

With continued reference to FIG. 3, equalizer plate 80 is positioned downstream of equalizer plate 78 and includes a plurality of flow passageways in the form of circular bores or thoughholes 110 extending vertically through the thickness of equalizer plate 80 from an upstream inlet to a downstream outlet. Each throughhole 110 is registered on an upstream surface 112 of equalizer plate 80 in substantial vertical alignment with one of the opposed closed curved ends 104, 106 of one of the slotted flow passageways 102. Adjacent throughholes 110 in each of the rows are spaced at equal centerline-to-centerline intervals, or a uniform pitch, across the width of the equalizer plate 80. The throughholes 110 in equalizer plate 80 and the slotted flow passageways 102 in equalizer plate 78 define a fourth stage or level of lateral thermoplastic material distribution in the linear flow equalizer 40.

The sheet-forming plate 82 includes opposed concavely-curved surfaces 114, 116 that integrate or merge the individual liquid flows streaming from the throughholes 110 of equalizer plate 80. Sheet-forming plate 82 effectively eliminates gaps between adjacent streams of molten thermoplastic polymer exiting the throughholes 110 to form a substantially uniform sheet of flowable thermoplastic material that is provided to the combining plate 42. The flowable thermoplastic material is subsequently filtered by the downstream filters 83, 84, 85 before being supplied to openings 86*a* extending through the filter support plate 86.

Figure 5A:
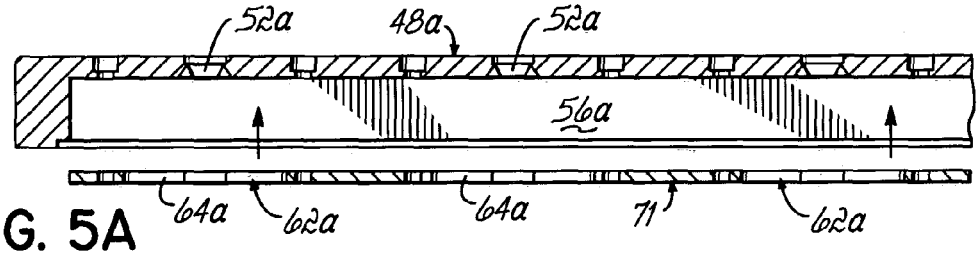
FIG. 5A is a cross-sectional view similar to FIG. 5 in accordance with an alternative embodiment of the invention.

With reference to FIG. 5A, each of the equalizer plate sets 50*a–c* may be provided in an equalizer plate 71 in which a set of channels 62*a* is formed. Each of the channels 62*a* includes multiple linear segments, of which only linear segment 64*a* is shown, arranged similarly or identical to channels 62 (FIGS. 4 and 5). Channels 62*a* are intended to replace channels 62 in inlet plate 48 (FIGS. 4 and 5). Consequently, an inlet plate 48*a* is modified to include three rows of inlet passageways 52*a* each of which supplies thermoplastic material to the center of one channel 62*a* for subsequent distribution to downstream equalizer plate 72. Equalizer plate 71 is installed in recess 56*a* of inlet plate 48*a* between equalizer plate 72 and inlet plate 48*a* and also in the other two recesses in inlet plate 48*a* (not shown but similar to recesses 57 and 58 in FIG. 3).

The invention further contemplates that additional pairs of equalizer plates (not shown) may be disposed between equalizer plate 80 and sheet-forming plate 82 to provide additional symmetrical and equal divisions of the flowable thermoplastic material in the flow path through the linear flow equalizer 40. The number of symmetrical and equal divisions will depend, among other variables, upon the width of the spin pack 32 in the cross-machine direction and, therefore, the width of the nonwoven web being formed by the spunbond system (not shown) with which spin beam assembly 10 is operative coupled.

With renewed reference to FIG. 3, seal 87 provides a fluid-tight junction between a downstream side of the filter support plate 86 and an upstream side of the combining plate 42. The combining plate 42 has internal liquid passageways 118 (FIG. 2) configured to receive the sheet-like flows of flowable thermoplastic materials from each of the linear flow equalizers 40 and to combine the flows to generate a bicomponent filament arrangement, such as a sheath/core arrangement or a side-by-side arrangement. In a sheath/core arrangement, for example, the flow path within the combining plate 42 of one of the two polymers is interposed and brought into coaxial alignment with the flow path of the other of the two polymers and directed the spinneret plate 44. The spinneret plate 44 has multiple spinneret holes or orifices 120 (FIG. 2) registered with liquid outlets in the combining plate 42 from which bicomponent filaments 122 (FIG. 2) are extruded for subsequent solidification, attenuation and collection as a non-woven web.

Figure 6:
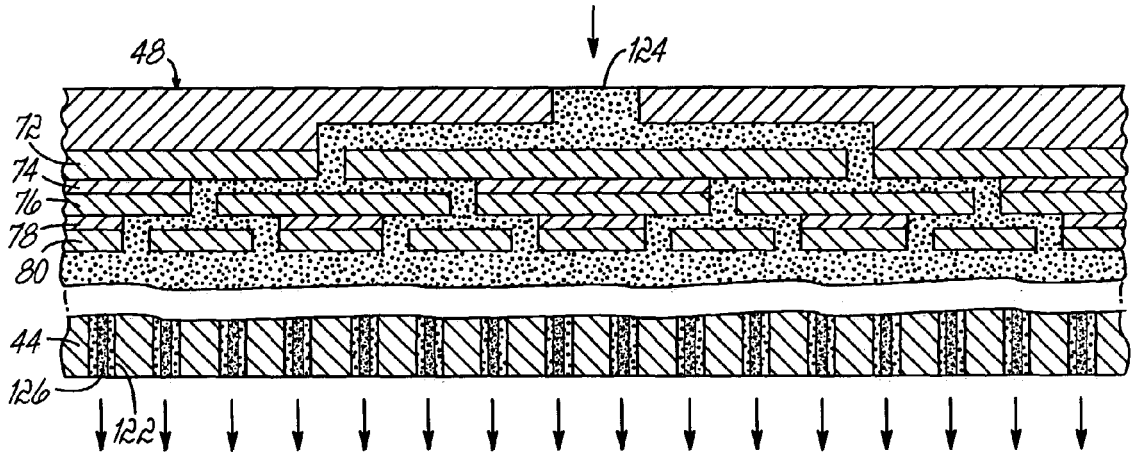
FIG. 6 is a diagrammatic view of the flow paths for molten thermoplastic polymer in the linear flow equalizer of FIG. 3.

With reference to FIG. 6, the operation of the linear flow equalizer 40 will be further explained. The flow path for a flowable thermoplastic material 124 through the linear flow equalizer 40 in a downstream direction from each inlet passageway 52 in inlet plate 48 to each throughhole 110 in equalizer plate 80 is substantially equal to or, preferable equal to, all other flow paths for the flowable thermoplastic material in the linear flow equalizer 40. Therefore, the linear flow equalizer 40 divides the flow evenly among all flow paths so that the residence time of any arbitrary volume of flowable thermoplastic material 124 flowing between inlet passageway 52 and the corresponding throughholes 110 is approximately equal and, preferably equal, and so that the properties (e.g., shear history) of the flowable thermoplastic material 124 exiting from each throughhole 110 are substantially identical and preferably equal.

In the exemplary embodiment, the flowable thermoplastic material 124 entering the inlet passageways 52 is divided by inlet plate 48 into eight substantially equal portions, each of which is further subdivided by equalizer plates 72, 74 into two substantially equal portions. It is understood that the number of substantially equal portions created by inlet plate 48 is dependent upon the width of the inlet plate 48 and equalizer plate sets 50*a–c* in the cross-machine direction. Equalizer plates 76, 78 further subdivide the portions received from equalizer plate 74 again into two substantially equal portions and directed through equalizer plate 80 to the combining plate 42 (FIG. 2). In the combining plate 42, the thermoplastic material 124, for example, Polymer A is combined with another thermoplastic material 126, for example, Polymer B, which is subdivided uniformly in the linear flow equalizer 40 in a manner substantially similar to thermoplastic material 124. The combined thermoplastic materials 124, 126 form bicomponent filaments 122, such as the sheath/core arrangement illustrated in FIG. 6, that are discharged from the spinneret orifices 120 in the spinneret plate 44 as a curtain of filaments 122 for subsequent collection. The invention contemplates that additional thermoplastic materials may be combined with the thermoplastic materials 124, 126 to form multicomponent filaments 122 with more than two constituent thermoplastic materials and that the constituent thermoplastic materials may have other configurations, such as side-by-side.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. For example, the principles of the invention may be applied for the formation of filaments composed of a single polymer or of filaments formed from more than two polymers. The invention in its broader aspects is therefore not limited to the specific details, representative apparatus and methods, and illustrative examples shown and described. Accordingly, departures may be made from such details without departing from the spirit or scope of applicant's general inventive concept. The scope of the invention itself should only be defined by the appended claims.

I claim:

1. A device for dividing a thermoplastic material supplied to a meltspinning apparatus having a cross-machine direction and a machine direction orthogonal to the cross-machine direction, the meltspinning apparatus having a plurality of liquid inlets for the thermoplastic material, the device comprising:

a linear flow equalizer including a plurality of flow passageways of substantially equal path length that extend in a downstream direction, each of said plurality of flow passageways receiving the thermoplastic material from at least one of the plurality of liquid inlets, said plurality of flow passageways arranged in a plurality of rows, each of said plurality of rows aligned in the cross-machine direction, adjacent pairs of said plurality of rows being positioned in a spaced relationship relative to each other in the machine direction, and said plurality of flow passageways in each of said plurality of rows dividing the thermoplastic material in the cross-machine and machine directions; and a forming member positioned downstream from said linear flow equalizer, said forming member having a surface oriented in the cross-machine direction and positioned relative to said plurality of flow passageways for intercepting the thermoplastic material discharged from said plurality of flow passageways.

2. The device of claim 1 further comprising:

a spinneret positioned downstream from said forming member, said spinneret having a plurality of orifices coupled by said forming member in fluid communication with said plurality of flow passageways for receiving the thermoplastic material and forming filaments therefrom.

3. The device of claim 1 wherein said plurality of flow passageways further comprises:

a first plurality of elongated slots each extending in the cross-machine direction and including opposed closed ends substantially equidistant from a corresponding one of the plurality of liquid inlets; and a first plurality of throughholes each substantially registered in alignment with one of said opposed closed ends of a corresponding one of said first plurality of elongated slots.

4. The device of claim 3 wherein said plurality of flow passageways further comprises:

a second plurality of elongated slots each extending in the cross-machine direction and including opposed closed ends substantially equidistant from a corresponding one of the first plurality of throughholes; and a second plurality of throughholes each substantially registered in alignment with one of said opposed closed ends of a corresponding one of said second plurality of elongated slots.

5. The device of claim 1 wherein said surface of said forming member is concavely curved.

6. A device for dividing a thermoplastic material supplied to a spin pack of a meltspinning apparatus having a cross-machine direction, the device comprising:

an inlet plate having a plurality of flow passageways for receiving the thermoplastic material, each of said plurality of flow passageways having an outlet, said plurality of flow passageways being spaced substantially equidistantly from each other in the cross-machine direction, and each of said plurality of flow passageways being substantially equal and substantially symmetrical in the cross-machine direction;

a first equalizer plate positioned downstream from said inlet plate, said first equalizer plate having a first plurality of elongated slots each centered about said outlet of a corresponding one of said plurality of flow passageways, each of said first plurality of elongated slots capable of receiving the thermoplastic material from the corresponding one of said plurality of flow passageways, and each of said first plurality of elongate slots extending in the cross-machine direction and including opposed closed ends substantially equidistant from the corresponding one of said plurality of liquid passageways;

a second equalizer plate positioned downstream from said first equalizer plate, said second equalizer plate having a first plurality of throughholes each substantially registered in alignment with one of said opposed closed ends of a corresponding one of said first plurality of elongated slots, each of said first plurality of throughholes capable of receiving the thermoplastic material from a corresponding one of said first plurality of slots, and said first and second equalizer plates cooperating to divide the thermoplastic material in the cross-machine direction; and a forming member positioned downstream from said second equalizer plate, said forming member having a first surface oriented in the cross-machine direction and positioned for intercepting the thermoplastic material discharged from said first plurality of throughholes.

7. The device of claim 6 further comprising:

a combining plate configured to combine the thermoplastic material from said forming member with another thermoplastic material; and a spinneret coupled in fluid communication with said combining plate, said spinneret receiving the combined thermoplastic materials and forming multicomponent filaments therefrom.

8. The device of claim 6 further comprising:

a third equalizer plate positioned downstream from said second equalizer plate, said third equalizer plate having a second plurality of elongated slots each substantially centered in the cross-machine direction about a corresponding one of said first plurality of throughholes, each of said second plurality of elongate slots having opposed closed ends substantially equidistant from the corresponding one of said first plurality of throughholes; and a fourth equalizer plate positioned downstream from said third equalizer plate, said fourth equalizer plate having a plurality of second throughholes each substantially registered in alignment with one of said opposed ends of a corresponding one of said second plurality of elongated slots.

9. The device of claim 6 wherein said first surface is concavely curved.

10. The device of claim 6 wherein said first plurality of elongated slots are arranged in substantially parallel first and second rows aligned in the cross-machine direction, and said first plurality of throughholes are arranged in substantially parallel first and second rows in the cross-machine direction.

11. The device of claim 10 wherein said first surface is concavely curved for intercepting the thermoplastic material discharged from said first row of the first plurality of throughholes, and said forming member further comprises a second concavely-curved surface positioned for intercepting the thermoplastic material discharged from said second row of said first plurality of throughholes.

12. The device of claim 6 wherein said inlet plate includes a plurality of liquid-carrying channels coupling the corresponding one of said plurality of flow passageways in fluid communication with a corresponding one of said first plurality of elongated slots.

13. The device of claim 12 wherein each of said plurality of liquid-carrying channels includes a plurality of linear segments that extend symmetrically in the cross-machine direction and in a machine direction, and said linear segments arranged such that said outlet of each of said first plurality of throughholes is positioned in a corresponding one of substantially parallel first and second rows aligned in the cross-machine direction.

14. The device of claim 12 wherein said inlet plate includes a downstream surface carrying said plurality of liquid-carrying channels, and a second plurality of throughholes upstream of said first equalizer plate, each of said second plurality of throughholes substantially registered in centered alignment with a corresponding one of said first plurality of elongated slots.

15. The device of claim 6 further comprising:

a third equalizer plate downstream of said inlet plate, said third equalizer plate having a plurality of liquid-carrying channels with a plurality of intersecting linear segments that extend symmetrically in the cross-machine direction, said plurality of liquid-carrying channels coupling said plurality of flow passageways of said inlet plate in fluid communication with said first plurality of elongated slots of said first equalizer plate.

16. The device of claim 15 wherein each of said plurality of liquid-carrying channels includes a plurality of intersecting linear segments that extend symmetrically in the cross-machine direction.

17. The device of claim 15 wherein said plurality of linear segments extend symmetrically in a machine direction orthogonal to the cross-machine direction.

18. The device of claim 15 wherein said plurality of liquid-carrying channels branch such that said first plurality of throughholes are arranged in substantially parallel first and second rows aligned in the cross-machine direction.

19. A device for dividing first and second thermoplastic materials in a cross-machine direction of a meltspinning apparatus, comprising:

a first linear flow equalizer including a first plurality of flow passageways of substantially equal path length that are arranged in the cross-machine direction and that extend in a downstream direction, said first plurality of flow passageways cooperating to divide the first thermoplastic material into individual streams having a spaced relationship in the cross-machine direction;

a first forming member positioned downstream from said first linear flow equalizer, said member having a surface oriented in the cross-machine direction and positioned relative to said first plurality of flow passageways for merging the individual streams of the first thermoplastic material exiting from said first plurality of flow passageways;

a second linear flow equalizer including a second plurality of flow passageways of substantially equal path length that cooperate to divide the second thermoplastic material into individual streams having a spaced relationship in the cross-machine direction; and a combining plate coupled by said first forming member in fluid communication with said first linear flow equalizer and coupled in fluid communication with said second linear flow equalizer, said combining plate capable of combining the first and second thermoplastic materials to form multi-component filaments.

20. The device of claim 19 wherein said second plurality of flow passageways of said second linear flow equalizer are arranged in the cross-machine direction and extend in the downstream direction.

21. The device of claim 19 further comprising:

a second forming member positioned downstream from said second linear flow equalizer and coupling said second linear flow equalizer with said combining plate, said member having a surface oriented in the cross-machine direction and positioned relative to said second plurality of flow passageways for merging the individual streams of the second thermoplastic material discharged from said second plurality of flow passageways.

* * * * *